US005229789A

United States Patent [19]

Kishida et al.

[11] Patent Number: 5,229,789

[45] Date of Patent: Jul. 20, 1993

[54] APPARATUS FOR THERMAL PRINTING

[75] Inventors: Juichi Kishida; Hiroyuki Ota; Hiroi Nakayama, all of Yokohama, Japan

[73] Assignee: Hitachi, Ltd., Tokyo, Japan

[21] Appl. No.: 625,043

[22] Filed: Dec. 10, 1990

[30] Foreign Application Priority Data

Dec. 20, 1989 [JP] Japan ..... 1-328138

[51] Int. Cl.[5] ..... B41J 2/335

[52] U.S. Cl. ..... 346/76 PH

[58] Field of Search ..... 346/76 PH; 400/120

[56] References Cited

U.S. PATENT DOCUMENTS 4,704,616 11/1987 Nakamura ..... 346/76 PH
4,806,725 2/1989 Narizuka et al. ..... 219/216
4,835,552 5/1989 Akutsu et al. ..... 346/76 PH

FOREIGN PATENT DOCUMENTS 128869 8/1983 Japan .
009769 1/1985 Japan .
232975 11/1985 Japan .
146566 7/1986 Japan .
278059 12/1987 Japan .
074657 4/1988 Japan .
286863 11/1989 Japan .

*Primary Examiner*—Benjamin R. Fuller
*Assistant Examiner*—N. Le
*Attorney, Agent, or Firm*—Antonelli, Terry, Stout & Kraus

[57] ABSTRACT

A laminated wiring conductor layer of a thermal printing head consists of common wiring connected to one end of a patterned heating resistor layer, and individual wirings connected to the other end of the patterned heating resistor layer. The individual wirings are separated from the common wiring by a predetermined interval. The laminated wiring conductor layer includes a plurality of conductor layers in which a first conductor layer exhibits excellent bonding to the heating resistor layer and cannot be readily soldered and hence prevents flow of a solder while a second conductor layer laminated on the first layer is easily soldered and less corrosive than aluminum.

16 Claims, 7 Drawing Sheets

APPARATUS FOR THERMAL PRINTING

BACKGROUND OF THE INVENTION

1. Field of the Invention

The present invention relates to a thin-film type thermal printing head for use in a printing portion of facsimiles, printers or the like, and a method of manufacturing the same. More particularly, the present invention pertains to the structure of wiring connected to heating resistors, the structure of solder connecting portions which provide an electrical connection to an external circuit by means of soldering, and a method of manufacturing such structures.

2. Description of Prior Art

The structure of a conventional thermal printing head will be described below with reference to FIGS. 1 to 3.

FIG. 1 is a perspective view of the conventional thermal printing head. Driving ICs 110 and one end of a flexible printed board 120 are soldered to a thermal printing head base 100 bonded to a heat sink 80. Connectors 130 are soldered to the other end of the flexible printed board 120. Signals for driving the head enter the thermal printing head through the connectors 130 from an external circuit, and control the driving ICs 110 and thereby drive heating resistors (not shown).

FIG. 2 is a plan view of the essential parts of the conventional thermal printing head base 100. Heating resistors 20 formed on a high-resistance substrate 10 are electrically connected to a common wiring 50 and individual wirings 30. The heating resistors 20 are also connected to an external circuit (not shown) through the flexible printed board 120 at solder connecting portions 61 connected to electrodes of the driving ICs 110 and at solder connecting portions 62 connected to electrode terminals of the flexible printed board 120.

FIG. 3 is a sectional view taken along the line A—A' of FIG. 2. A heating resistor layer 21 made of an alloy of chromium and silicon is formed on the high-resistance substrate 10 composed of a ceramic layer 11, a glaze layer 12 and tantalum pentaoxide layer 13 by sputtering, and a 0.1 μm thick chromium layer 31 and a 0.8 μm thick aluminum layer 34 are then formed on the heating resistor layer 21 in sequence by sputtering to form the wiring 30. Thereafter, an unnecessary portion of the wiring 30 and that of the heating resistor layer 21 are removed by the photolithographic process to form the heating resistors 20.

Next, to protect the heating resistors 20 and the wiring 30, a protective layer 40 consisting of two layers is formed first by forming a silicon dioxide layer 41 to a thickness of 4.0 μm by sputtering and then forming through-holes by the photolithographic process and then by forming a polyimide layer 42 to a thickness of 3.5 μm and then forming through-holes by the photolithographic process. Subsequently, the common wiring 50 and the solder connecting portions 60, each composed of a chromium layer 51, a copper layer 52 and a gold layer 53, are formed at the same time using both the sputtering and the photolithographic process. Thereafter, an abrasion resistant protective layer 71 made of, for example, silicon nitride, is formed selectively on both the common wiring 50 and the heating resistor 20 by the plasma CVD process.

The thermal printing head of the above-described type may be employed in the thermal printing method. In that case, a thermal printing paper is moved, perpendicularly to the paper on which FIG. 3 is depicted, from the right to the left by a platen roller (not shown) while being pressed against the heating resistors. In consequence, lees 91 of the printing paper remain at the shoulder of the common wiring 50, deteriorating contact of the printing paper with the heat transmitting portion of the upper portions of the heating resistors. This necessitates cleaning of the head once a month in a case where the head is used at a normal frequency.

In the above-described conventional thermal printing head, the protective layer 40 is made up of the silicon dioxide layer 41 and the polyimide layer 42 to attain reliability because the easily corrosive aluminum layer 34 is used to form the wiring 30. The thickness of the silicon dioxide layer 41 is particularly important. That is, to prevent corrosion of the aluminum layer 34, the silicon dioxide layer 41 must have a thickness of 4.0 μm or above. The silicon dioxide layer 41 is formed on the heating resistor 20 also, and the thickness thereof thus greatly affects the printing characteristics. In the case where aluminum is used as a metal for wiring, a level of printing energy must therefore be enhanced because of the thickness of the silicon dioxide layer 41. Further, the polyimide layer 42 is used as a stress relieving film to prevent the glaze layer 12 from being cracked by the stress applied thereto from the electrode connecting solder when the driving ICs are mounted.

The use of the wiring made up of at least two layers, as in the case of the above-described conventional thermal printing head, e.g., the use of the wiring made up of, for example, a lower chromium layer and an upper aluminum layer, as disclosed in Japanese Patent Unexamined Publication No. 61-43449, assures economic wiring substrate. However, this necessitates formation of another solder connecting metal layer on the aluminum layer because the normally employed solder does not alloy with aluminum.

In the solder connecting portion 60 employed in the above conventional thermal printing head, the copper layer 52 is connected to a solder, the gold layer 53 has a function of preventing oxidation of the surface of the copper layer 52, and the chromium layer 51 has a function of bonding the solder connecting portion 60 to a layer disposed below it.

Japanese Patent Unexamined Publication No. 63-28665 discloses a thermal printing head which employs copper as a wiring metal and an alloy of nickel and copper as a solder connecting metal. Although the alloy of nickel and copper ensures excellent solder connection, the number of metal layers in the thermal printing head is increased, making the manufacturing process complicated. Furthermore, no consideration is given to a change in the thickness of the protective layer caused by a change in the wiring metal.

Thus, in the conventional thermal printing heads, the lees 91 of the printing paper easily remain at the shoulder of the common wiring. This makes frequent cleaning of the head necessary. Furthermore, in a case where aluminum is used as a wiring metal, the thickness of the protective layer must be increased. This prevents reduction in the power consumption of the thermal printing head. Also, in a case where aluminum is used as a wiring metal, since the electrical connection with an external circuit is achieved by the soldering process, a solder connecting metal other than that used in the wiring must be used.

As stated above, the conventional thermal printing heads have disadvantages in that the thickness of the protective layer must be increased and the level of printing energy must therefore be enhanced because of the use of aluminum as the wiring metal, in that the use of different metals for the wiring and for the solder connecting portions and common wiring makes the overall configuration complicated, and in that frequent cleaning is required, making the operation of the head uneconomical.

SUMMARY OF THE INVENTION

In view of the aforementioned problems of the prior art, objects of the present invention are to provide a thermal printing head which requires less amount of printing energy, which ensures highly reliable connection, and which eliminates frequent cleaning and is hence economical, and to provide a method of manufacturing the thermal printing head.

One of the above-described objects of the present invention is achieved by the provision of a thermal printing head in which common metals are used for wiring and solder connection and in which one of at least two layers constituting the wiring is made of a solder connecting metal which is less corrosive than aluminum while the other one layer is made of a metal which cannot be readily soldered and therefore prevents flow of a solder.

According to one aspect of the present invention, there is provided a thermal printing head which comprises: a patterned layer of a plurality of heating resistors arranged in line on a high-resistance substrate; a laminated wiring conductor layer consisting of common wiring connected to one end of the patterned heating resistor layer and individual wirings connected to the other end of the patterned heating resistor layer, the individual wirings being separated from the common wiring by a predetermined interval; a heat-resistant insulating layer formed at least one ht laminated wiring conductor layer and on an exposed portion of the patterned heating resistor layer on which the wiring conductor layer is not formed; an abrasion-resistant protective layer provided at least above the exposed portion of the patterned heating resistor layer with the heat-resistant insulating layer being interposed therebetween; solder connecting portions formed by forming through-holes in a portion of the heat-resistant insulating layer placed on the individual wirings, the solder connecting portions being connected to driving ICs; and driving ICs soldered to the solder connecting portions. The laminated wiring conductor layer includes a plurality of conductor layers in which a first conductor layer exhibits excellent bonding to the heating resistor layer and cannot be readily soldered and hence prevents flow of a solder while a second conductor layer laminated on the first layer is easily soldered and less corrosive than aluminum.

In one preferred form of the present invention, the laminated wiring conductor layer consists of the first and second layers, and a groove is formed around an exposed portion of the second conductor layer in each of the driving IC soldering portions formed by forming the through-holes in the portion of the heat-resistant insulating layer placed on the individual wirings to expose the first conductor layer. The exposed portion of the first conductor layer serves as a solder flow preventing portion during solder connection.

In another preferred form of the present invention, the laminated wiring conductor layer includes three layers with a third layer being laminated on the second layer. A portion of the third layer located in each of the solder connecting portions formed by forming the through-holes in the portion of the heat-resistant insulating layer placed on the individual wirings is selectively removed to expose a portion of the second layer to make it serve as a solder connecting portion.

In that case, the first and third layers may be made of the same metal.

The first layer may be made of a simple metal selected from a group consisting of chromium, titanium, molybdenum and tungsten, or an alloy of the metals, and the second layer may be made of copper or a copper alloy.

The heat-resistant insulating layer may be made of silicon dioxide, and the abrasion-resistant protective layer may be made of silicon nitride.

According to another aspect of the present invention, there is provided a method of manufacturing a thermal printing head, which comprises the steps of: forming a patterned layer of a plurality of heating resistors arranged in line on a high-resistance substrate; forming a laminated wiring conductor layer consisting of at least first and second layers on the patterned heating resistor layer; forming heating resistors by conducting selective etching to form a wiring pattern in which a portion of the wiring conductor layer located on one end of the patterned heating resistor layer is left as a common wiring layer, in which a portion of the wiring conductor layer located on the other end of the patterned heating resistor layer is left as an individual wiring layer, and in which a main surface of the patterned heating resistor layer located between the wiring layers is exposed; forming a heat-resistant insulating layer at least on the wiring pattern and on a portion of the patterned heating resistor layer which is exposed by the selective etching of the wiring pattern; forming solder connecting portions connected to driving ICs, the solder connecting portions being formed by forming through-holes in a portion of the heat-resistant insulating layer located above the individual wiring layer; and forming an abrasion-resistant protective layer above the heating resistors with the heat-resistant insulating layer being interposed therebetween. The first layer of the wiring conductor layer is made of a simple metal selected from a group consisting of chromium, titanium, molybdenum and tungsten, or an alloy of the metals, and the second layer is made of copper or a copper alloy.

According to still another aspect of the present invention, there is provided a method of manufacturing a thermal printing head, which comprises the steps of: forming a patterned layer of a plurality of heating resistors arranged in line on a high-resistance substrate; forming a laminated wiring conductor layer consisting of first, second and third layers on the patterned heating resistor layer; forming heating resistors by conducting selective etching to form a wiring pattern in which a portion of the wiring conductor layer located on one end of the patterned heating resistor layer is left as a common wiring layer, in which a portion of the wiring conductor layer located on the other end of the patterned heating resistor layer is left as an individual wiring layer, and in which a main surface of the patterned heating resistor layer located between the wiring layers is exposed; forming a heat-resistant insulating layer at least on the wiring pattern and on a portion of the patterned heating resistor layer which is exposed by the selective etching of the wiring pattern; forming solder connecting portions connected to driving ICs, the solder connecting portions being formed by forming through-holes in a portion of the heat-resistant insulating layer located above the individual wiring layer and then by conducting selective etching on the third wiring conductor layer to expose the second wiring conductor layer; and forming an abrasion-resistant protective layer above the heating resistors with the heat-resistant insulating layer being interposed therebetween. The first layer of the wiring conductor layer is made of a simple metal selected from a group consisting of chromium, titanium, molybdenum and tungsten, or an alloy of the metals, and the second layer is made of copper or a copper alloy.

The first and second wiring conductor layers may be made of the same metal.

The laminated wiring conductor layer may be continuously formed by sputtering.

The heat-resistant insulating layer may be made of silicon dioxide and formed to a thickness of less than 4 μm by sputtering, and the abrasion-resistant protective layer may be made of silicon nitride and formed by the plasma PVD process.

In the present invention, reliability can be maintained even when common metals are used to form the wiring portion and solder connecting portions. In consequence, the manufacturing process can be simplified and economical manufacture of thermal printing heads is thus made possible. Furthermore, since the thickness of the protective layer for the wiring metals can be reduced, the level of printing energy supplied can be reduced. Furthermore, since the amount of lees of printing paper can be reduced, the frequency of cleaning the thermal printing head can be reduced.

DETAILED DESCRIPTION OF THE PREFERRED EMBODIMENTS

Embodiments of the present invention will now be described with reference to FIGS. 4 to 12.

Embodiment 1

Figure 4:
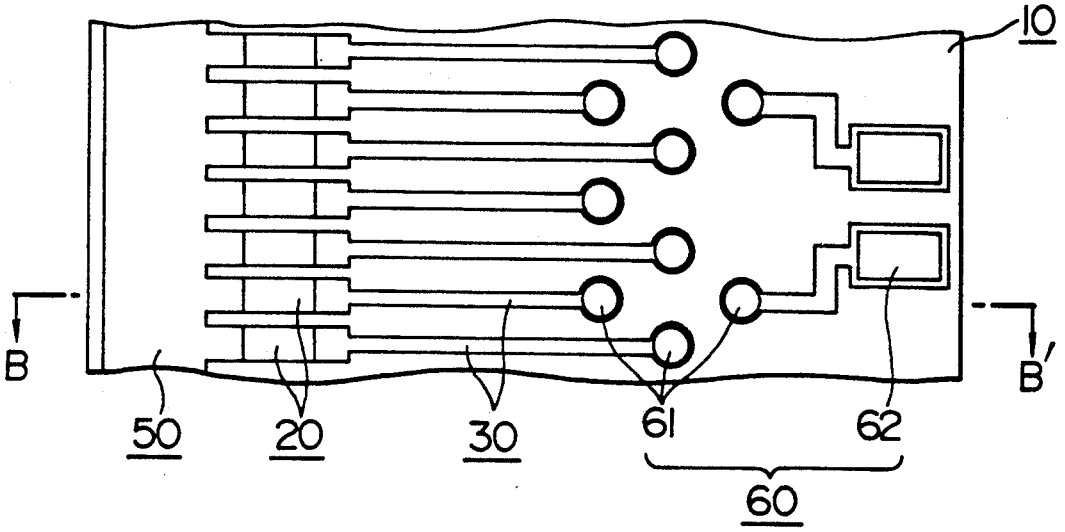
FIG. 4 is a plan view of the essential pa ts of an embodiment of the thermal printing head according to the present invention.
Figure 5:
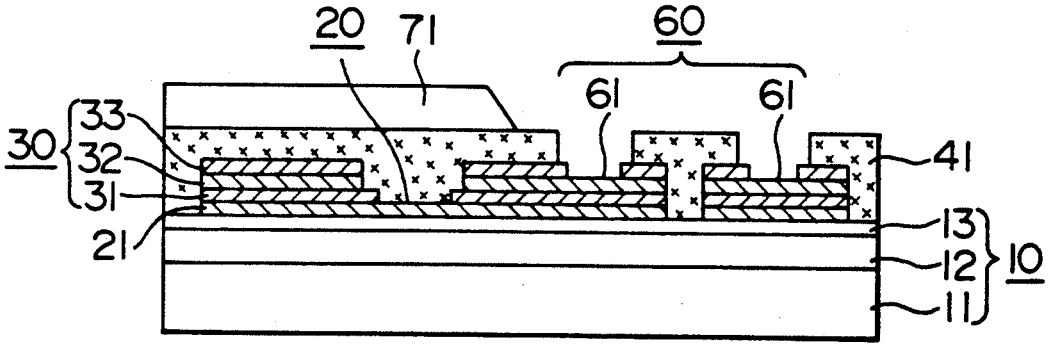
FIG. 5 is a sectional view taken along the line B—B' of FIG. 4.

FIG. 4 is a plan view of the essential parts of an embodiment of a thermal printing head according to the present invention, and FIG. 5 is a sectional view taken along the line B—B' of FIG. 4.

Figure 1:
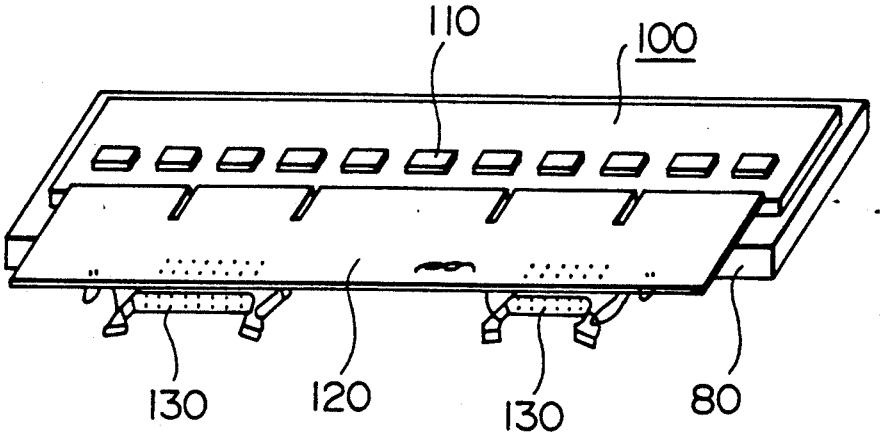
FIG. 1 (PRIOR ART)
FIG. 1 is a perspective view of a thermal printing head.
Figure 2:
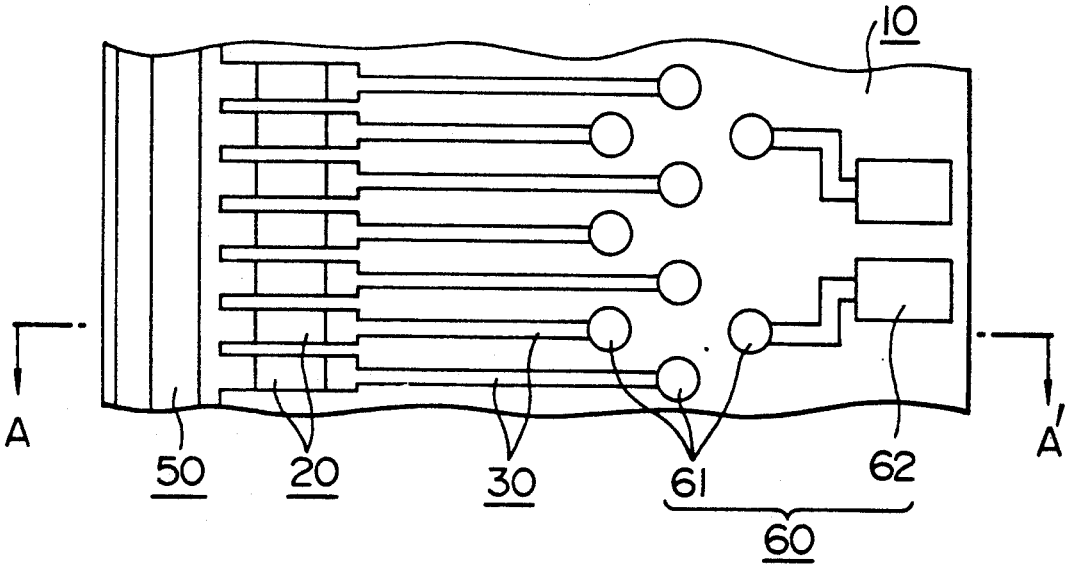
FIG. 2 (PRIOR ART)
FIG. 2 is a plan view of the essential parts of a conventional thermal printing head.
Figure 3:
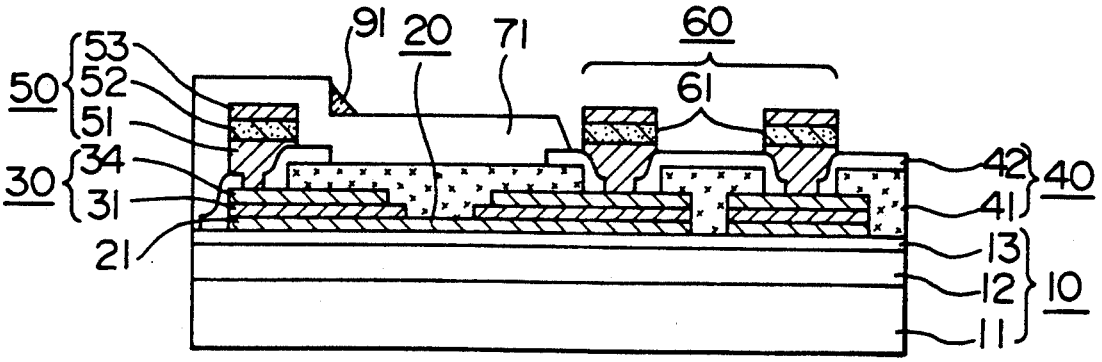
FIG. 3 (PRIOR ART)
FIG. 3 is a sectional view taken along the line A—A' of FIG. 2.

In FIGS. 4 and 5, the same reference numerals are used to denote parts which are the same as those in FIGS. 2 and 3. As in the case of the configuration shown in FIG. 2, the heating resistors 20 formed on the high-resistance substrate 10 are electrically connected to the common wiring 50 and the individual wirings 30. The heating resistors 20 are also connected to an external circuit through the solder connecting portions 61 connected to the electrodes of the driving ICs 110 and through the solder connecting portions 62 connected to the terminals of the flexible printed board 120. However, the common wiring 50 is formed concurrently with the formation of the solder connecting portions 60 in the case of the structure shown in FIG. 2, whereas in the present embodiment it is formed together with the individual wirings 30.

This will be described below in detail with reference to FIG. 5.

After a heating resistor layer 21, made of an alloy of chromium and silicon, has been formed to a thickness of 20 to 30 nm by sputtering on the high-resistance substrate 10 composed of the ceramic substrate 11, the glaze layer 12 and the tantalum pentaoxide layer 13, a chromium layer 31, which is the first layer of the wiring 30, a copper layer 32, which is the second layer of the wiring 30, and a chromium layer 33, which is the third layer thereof, are respectively formed by sputtering to thicknesses of 0.15 μm, 2.5 μm and 0.03 μm on the heating resistor layer 21. Next, an unnecessary portion of the chromium layer 33 is removed by the photolithographic process using a predetermined mask, and unnecessary portions of the copper layer 32, chromium layer 31 and heating resistor layer 21 are then removed to form the heating resistors 20 and the solder connecting portions 60. The heating resistors 20 are connected to the common wiring portion 50 constituted by the wiring 30 and to the individual wiring portion 30. The solder connecting portions 60 are through-holes formed in the chromium layer 33 of the individual wiring portion 30. Subsequently, the silicon dioxide layer 41 is formed by sputtering to a thickness of 2.0 μm on the heating resistors 20 and on the wiring 30 as a protective layer. Then, the silicon nitride layer 71 is partially formed by the plasma CVD process to a thickness of 1.5 μm as the abrasion-resistant protective layer on the silicon dioxide protective layer 41 below which the common wiring and the heating resistors 20 exist. Thereafter, through-holes are formed by the photolithographic process in the portions of the silicon dioxide layer 41, which correspond to the solder connecting portions 60. The through-holes 61 constitute the solder connecting portions 60 in the present embodiment.

The thus-obtained thin-film type thermal printing head has a structure which permits continuous manufacture by a normally adopted carousel type sputtering apparatus except for the silicon dioxide layer 41. It is therefore possible to form the heating resistors, wiring and driving IC connecting metal layer in sequence within the same film forming apparatus.

Furthermore, since the copper layer 32 is used as a wiring metal in place of the conventionally employed easily corrosive aluminum, high reliability can be assured with the protective film 41 composed of the silicon dioxide film having a thickness of only 2.0 μm. Also, since the stress applied by the soldering conducted on the thermal printing head provided with the glaze layer 12 is relieved by the copper layer 32, the stress does not directly reach the glaze layer 12. It is therefore possible to maintain reliability.

Since the protective silicon dioxide film 41 is formed also on the heating resistor layer 21, the thickness of the silicon dioxide film 41, which was at least 4.0 μm in the conventional thermal printing head, can be reduced to 2.0 μm, thereby making it possible to reduce by 2.0 μm, the distance between the heating resistors 20 and the printing paper. This improves the heat conduction efficiency, which leads to reduction in the printing energy.

Figure 8:
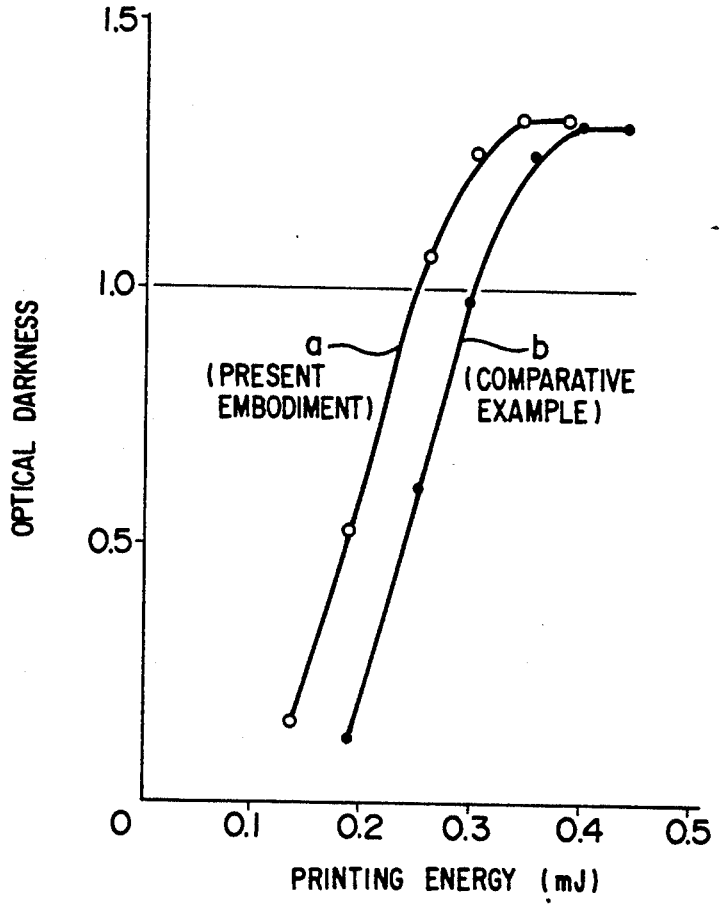
FIG. 8 is a graph showing how the characteristics of the conventional thermal printing head shown in FIG. 3 differ from those of the thermal printing head of the present invention shown in FIG. 5.

FIG. 8 is a graph showing the printing characteristics of the thermal printing head according to the present embodiment. The abscissa axis represents power applied to the heating resistors, and the ordinate axis represents optical darkness of the printing paper. For comparison, a printing characteristic curve b of the conventional thermal printing head shown in FIGS. 2 and 3 is also shown. The curve b is on the right side of the printing characteristic curve a of the present embodiment, which means that the conventional thermal printing head requires a higher level of energy for printing. For example, the conventional thermal printing head requires 0.3 mJ of printing energy to achieve an optical darkness of 1.0, whereas the present embodiment requires only 0.24 mJ of energy to obtain the same optical darkness, which is about 20% reduction.

Figure 9:
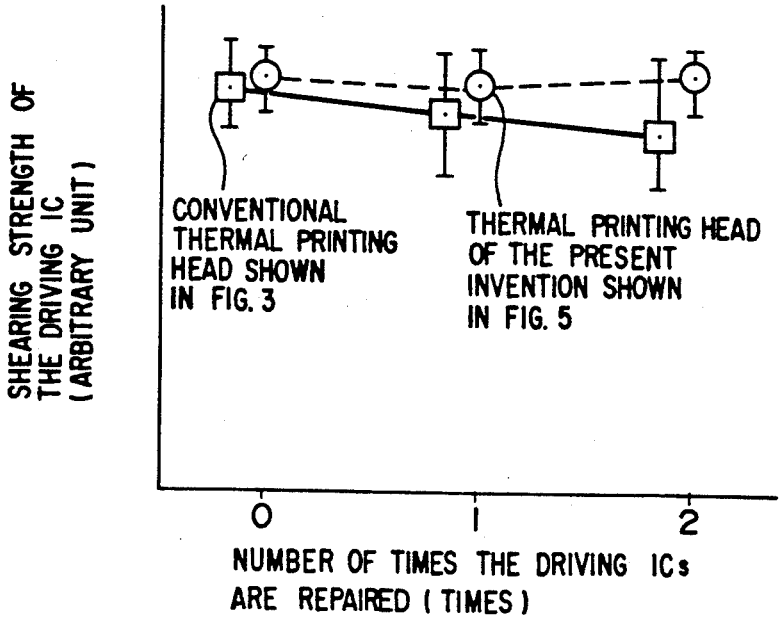
FIG. 9 is a graph showing how the strength of the connection between conductors and the driving ICs differs due to the difference in the thin-film structure between the conventional thermal printing head shown in FIG. 3 and that shown in FIG. 5.

FIG. 9 is a graph showing the results of measurements of the connection strength with which the heating resistor driving ICs are soldered to the IC connecting portions 60. The abscissa axis represents the number of times the driving ICs are repaired, and the ordinate axis represents the shearing strength. The number of times the driving ICs are repaired refers to the number of times the defective driving ICs are replaced with new ones. The thermal printing head generally employs a large number of driving ICs, and the technique of repairing the defective ICs is inevitable. In the graph shown in FIG. 9, 0 time means the initial stage of the use. To facilitate comparison, the solder connected area is made the same in both examples. As can be seen from FIG. 9, the initial connection strength is the same in both the comparative example shown in FIG. 3 and the present embodiment shown in FIG. 5. However, in the conventional example, as the number of times the driving ICs are repaired increases, the connection strength reduces, and the dispersion in the measurement of connection strength is wide, whereas in the present embodiment repair does not reduce the connection strength, and the dispersion in the measurement of connection strength is narrow.

In the thermal printing head shown in FIGS. 4 and 5, the chromium layer 33 which is the third layer of the wiring consisting of the three layers acts as a solder flow preventing layer. This makes the wiring a highly reliable and economical one. Furthermore, since the second metal layer in the wiring is made of 2.5 μm thick copper which allows for soldering connection and which has a low specific resistance, the outlet side of the printing paper (not shown) can be made flat, thus reducing the frequency with which the paper lees are removed. Furthermore, since the protective film 41 for the copper layer 32 is made up of the silicon dioxide layer having a thickness of 2.0 μm, the heat emanating from the heating resistors 20 reaches the thermal printing paper more efficiently. This makes it possible to reduce the level of printing energy.

As stated above, it is possible by the thermal printing head of the present embodiment to reduce the level of printing energy and to increase the strength of the solder connected portions. Furthermore, since the wiring layer 30 constitutes both the common wiring and the individual wirings, the manufacturing process can be reduced and the manufacturing efficiency can thus be enhanced. Furthermore, in the conventional thermal printing head, the lees of the printing paper readily remain at the shoulder of the abrasion-resistant protective film 71 located near the outlet side of the printing paper, so cleaning is required at least once a month. However, in the thermal printing head of the present embodiment, there exists no shoulder, and the frequency with which cleaning is done can thus be reduced to about once a year.

Embodiments of the method of manufacturing a thermal printing head according to the present invention will now be described with reference to FIGS. 10 to 12.

FIGS. 10 to 12 mainly show the process of manufacturing the solder connecting portions 60.

Embodiment 2

Figure 10A:
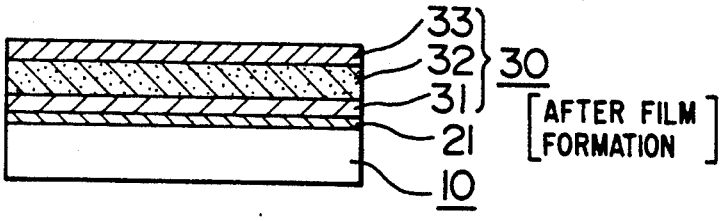
FIGS. 10 to 12 respectively show different embodiments of thermal printing head manufacturing methods according to the present invention.
Figure 10B:
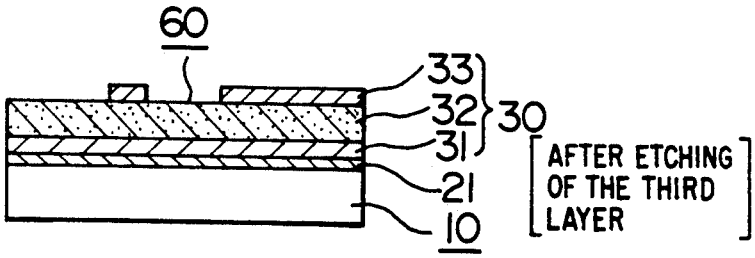
Figure 10C:
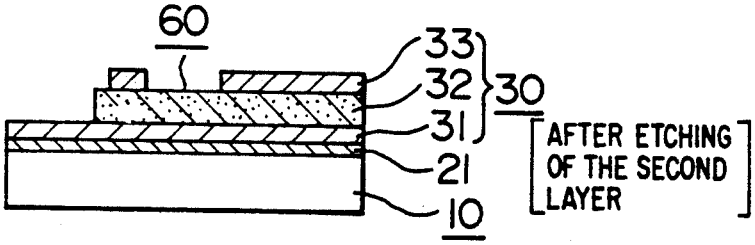
Figure 10D:
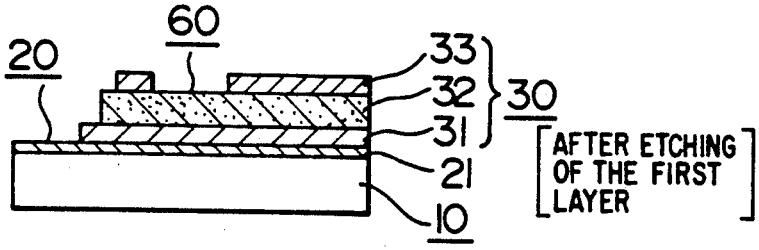

FIGS. 10A–10D show an embodiment of the simplest manufacturing process. As shown in FIG. 10A, the chromium layer 31 which is the first layer of the wiring layer 30, the copper layer 32 which is the second layer thereof, and the chromium layer 33 which is the third layer thereof are formed in sequence by sputtering. Thereafter, a resist mask having a predetermined pattern is formed on each of the three layers and etching is conducted thereon one layer at a time, starting from the third layer, as shown in FIGS. 10B to 10D. That is, the third chromium layer 33 is selectively etched first to form the solder connecting portions 60, as shown in FIG. 10B. Next, the second copper layer 32 is selectively etched, as shown in FIG. 10C, and the first chromium layer 31 is then selectively etched to partially expose the heating resistor layer 21, as shown in FIG. 10D. Thereafter, although not shown in the drawing, partial etching of the heating resistor layer 21, formation of the protective film 41 and abrasion-resistant protective layer 71, connection of the flexible printed board 120, mounting of the driving ICs 110, electrode connection and so on continue until manufacture of the thermal printing heads is completed.

Embodiment 3

Figure 11A:
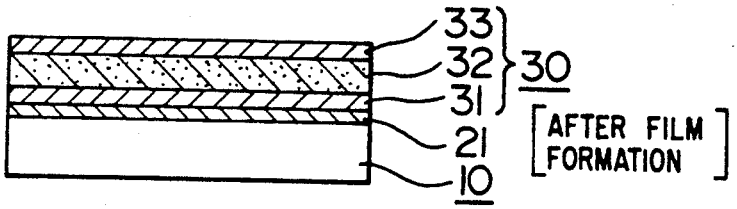
Figure 11B:
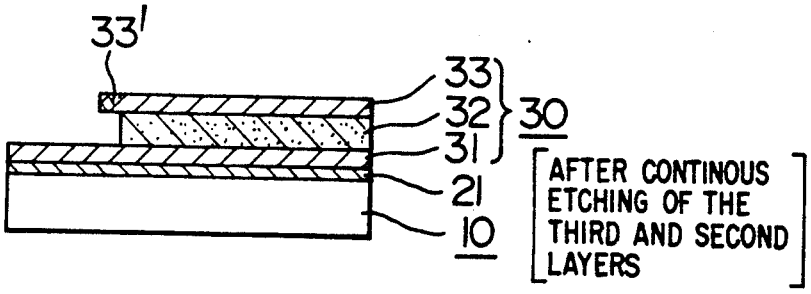
Figure 11C:
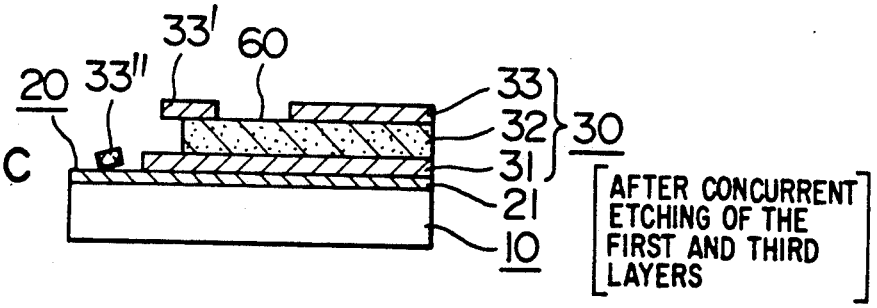

FIGS. 11A–11C are views similar to FIGS. 10A–10D, showing another embodiment of the thermal printing head manufacturing method according to the present invention, in which the number of resist mask forming processes is reduced by one to reduce the amount of chemicals used and working hours.

In the present embodiment, as shown in FIG. 11A, after the wiring layer 30 has been formed in the same manner as shown in FIG. 10A, the third chromium layer 33 and the second copper layer 32 are successively and selectively removed by etching using the same photoresist mask, as shown in FIG. 11B, to make the first chromium layer 31 exposed. Thereafter, the resist mask is removed, and the unnecessary portions of the third chromium layer 33 and the unnecessary portions of the first chromium layer 31 are removed by etching at the same time, as shown in FIG. 11C. Removal of the unnecessary portions of the third chromium layer 33 forms the solder connecting portions 60. In this way, the number of resist pattern forming processes can be reduced by one, thereby reducing the amount of chemicals and the working hours. However, in a case where the third chromium layer 33 and the second copper layer 32 are successively removed by etching, since a mixture solution of iodine and ammonium iodide, which is used for etching the copper layer 32, etches the side portions of the copper layer 32 excessively, overhanging portions 33' of the third chromium layer 33 may be generated, as shown in FIG. 11B. The overhanging portions 33' are separated from the chromium layer 33 to form separated portions 33'' when the photoresist mask is formed for the first chromium layer 31. The separated portions 33'' placed below the resist mask pattern may cause pattern defects, which in turn causes entry of foreign matter in the subsequent sputtering process. Therefore, formation of the separated portions 33'' must be eliminated. This problem is solved by Embodiment 4 described below.

Embodiment 4

FIGS. 12A–12D are views similar to FIGS. 10A–10D, showing an embodiment of the present invention in which, in comparison with the embodiment shown in FIGS. 11A–11C, the overhanging portions 33' of the third chromium layer 33 are removed by etching before they are separated from the chromium layer 33.

Figure 12A:
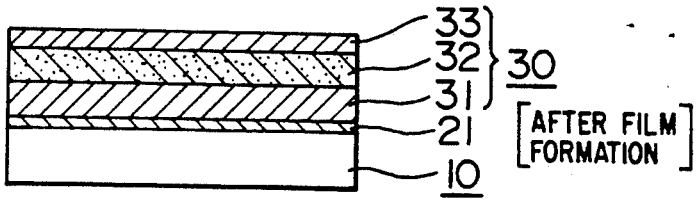
Figure 12B:
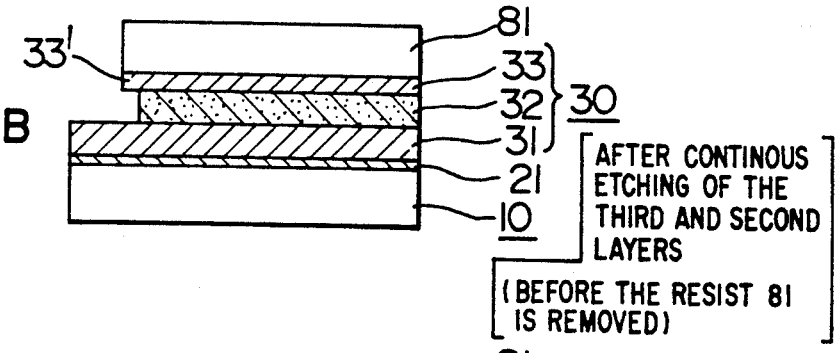
Figure 12C:
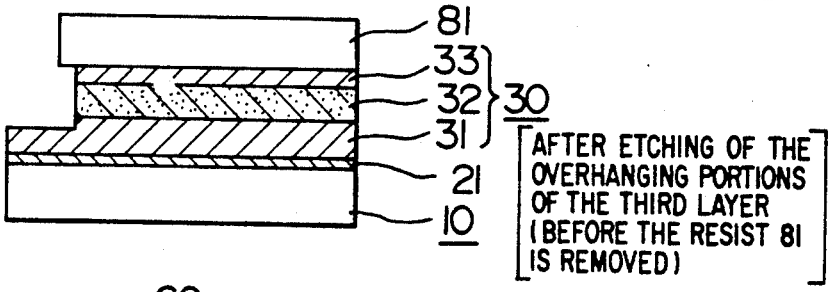

In the present embodiment, as shown in FIG. 12A, after the wiring layer 30 has been formed in the same manner as shown in FIG. 10A, the third chromium layer 33 and the second copper layer 32 are successively etched using a photoresist mask 81, as shown in FIG. 12B. Thereafter, etching is conducted on the chromium layer 33 again using potassium ferricyanide which is the selective etchant for the chromium layer 33, as shown in FIG. 12C, to remove the overhanging portions 33' of the chromium layer 33. It is thus possible to reduce the number of resist mask forming processes by one without generating the wiring pattern defects and, hence, without increasing the amount of foreign matter in the sputtering process, thereby reducing the amount of chemicals used and working hours. It is noted that the third chromium layer 33 and the first chromium layer 31 are etched at the same time by the same etchant. However, it is possible to completely prevent the separated portions 33'' from being formed and to restrict etching on the first chromium layer 31 to a light etching thus leaving the first chromium layer 31 over the entire surface of the substrate, by making the difference in thickness between the two layers 33 and 31 large and by conducting etching on both the overhanging portions 33' and the chromium layer 31 exposed by the etching of the copper layer 32 for a time sufficient to etch only the overhanging portions 33' after etching has been conducted on the copper layer 32.

Figure 12D:
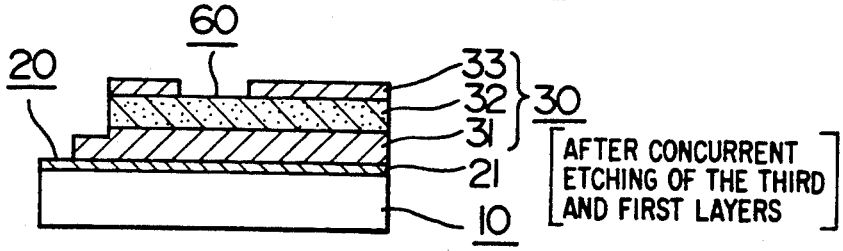

Thereafter, as shown in FIG. 12D, a predetermined photoresist mask is formed and selective etching is then conducted on both the third chromium layer 33 and the first chromium layer 31 in the same manner as shown in FIG. 11C to form the solder connecting portions 60 and the wiring pattern for the heating resistors 20 at the same time.

In the process shown in FIG. 12C, the first chromium layer 31 is left over the entire surface of the substrate. In a case where only the portion of the first chromium layer 31 placed below the second copper layer 32 is to be left, however, it is not necessary to give consideration on the difference in the thickness between the third chromium layer 33 and the first chromium layer 31, and the first chromium layer 31 may be continuously etched after selective etching has been conducted on the copper layer 32. Conversely, in a case where the third and first layers of the wiring portion 30 are made of metals which permit selective etching, the overhanging portions can be removed completely without the metal which forms the first layer being lightly etched.

In the thermal printing head manufacturing methods shown in FIGS. 10 to 12, the third chromium layer 33 acts as a metal layer which prevents flow of solder. This makes the methods highly reliable and economical.

Embodiment 5

Figure 6:
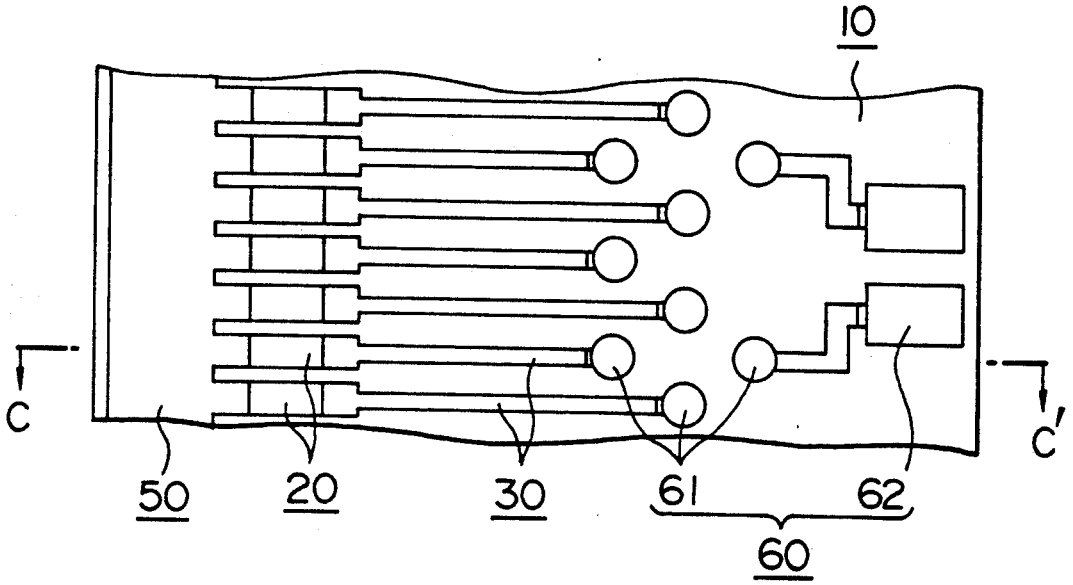
FIG. 6 is a plan view of the essential parts of another embodiment of the thermal printing head according to the present invention.
Figure 7:
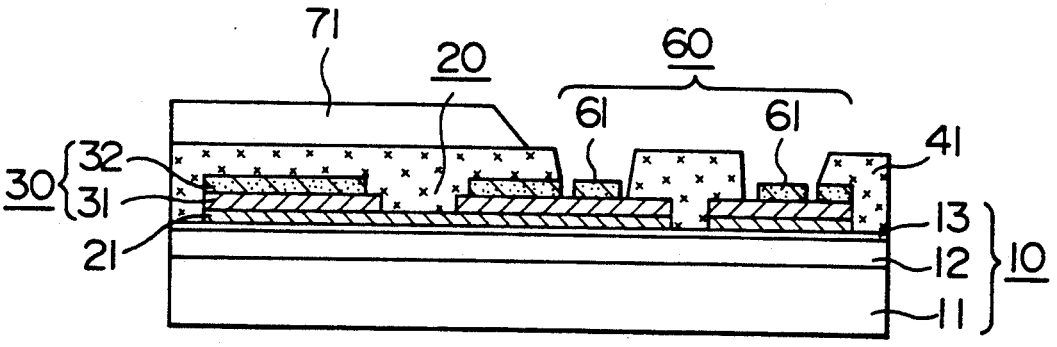
FIG. 7 is a sectional view taken along the line C—C' of FIG. 6.

FIG. 6 is a plan view of the essential parts of an embodiment of the thermal printing head according to the present invention in which the wiring 30 is composed of the first layer made of chromium and the second layer made of copper, and FIG. 7 is a sectional view taken along the line C—C' of FIG. 6.

The configuration of the present embodiment is basically the same as that of the Embodiment 1 shown in FIGS. 4 and 5. The same reference numerals are thus used to denote parts which are the same as those of the Embodiment 1.

The differences between the present embodiment and the Embodiment 1 are that the wiring 30 in the present embodiment consists of the first layer made of 0.1 μm thick chromium layer 31 and the second layer made of 2.5 μm copper layer 32, and that a solder is connected to the second copper layer 32 while the chromium layer 31 acts as a solder flow preventing layer.

With the thin film structure of the present embodiment, the heating resistors 20, the wiring 30 and the driving IC connecting electrodes 60 can be continuously formed within the same film forming apparatus, like that of the Embodiment 1. Furthermore, since conventionally used, easily corrosive aluminum is not used as the wiring metal, a protective silicon dioxide layer 41 having a thickness of 2.0 μm is enough to achieve reliability of the wiring. Furthermore, as compared with the Embodiment 1, the cost of materials and the working hours can be reduced because of absence of the third chromium layer 33.

When solder connection is conducted on the thermal printing head of the present embodiment for mounting the driving ICs, however, a solder may flow around the side face of the copper layer 32 of the connecting portions 61. In that case, since the chromium layer 31 is unable to relieve stress applied by the solder, stress may be transmitted to the glaze layer 12, generating cracks therein. Hence, the use of a high-resistance substrate 10 which does not employ a glass or glaze layer is desired.

In the present embodiment, a groove is provided around the copper layer 32 which forms the solder connecting portion 61, i.e., between the connecting portion 61 and the protective layer 41, to expose the chromium layer 31 and thereby enable it to act as a solder flow preventing layer.

In the thermal printing head having the structure shown in FIGS. 6 and 7, since a solder is connected to the copper layer 32 in the wiring portion 30 while the chromium layer 31 acts as a solder flow preventing layer, formation of the wiring is made economical. Furthermore, since the second layer of the wiring portion is made of 2.5 μm thick copper which has a low specific resistance and which exhibits excellent solder connection, the outlet portions of the heating resistors 20 from which the printing paper leaves the heating resistors 20 can be made flat. This allows the frequency with which the lees of the paper are removed to be reduced. Furthermore, since the protective film 41 for the copper layer 32 is made of 2.0 μm thick silicon dioxide, the efficiency with which the heat emanating from the heating resistors 20 reaches the thermal printing paper can be increased. This allows the level of printing energy to be reduced.

In the above-described typical embodiments of the present invention, chromium which is readily bonded to the patterned heating resistor layer 21 and which is not readily connected to a solder is used to form the first and third layers of the wiring layer 30. However, titanium, molybdenum, tungsten or an alloy of these metals may be employed to form these layers. Also, copper used to form the solder connecting second layer which is less oxidized (corrosive) than the aluminum layer may be replaced, for example, by NiCu, CrCu or a copper alloy. Furthermore, the first and third layers may not be formed of the same metal. Metals may be adequately selected in accordance with the pattern forming process.

Furthermore, the wiring layer 30 may consist of four or more layers when necessary. However, a wiring layer consisting of two or three layers is practical.

As will be understood from the foregoing description, the thin film structure for the wiring of the thermal printing head according to the present invention consists of two or more layers, wherein at least one layer is made of copper or a copper alloy which exhibits excellent solder connection and the other at least one layer is made of chromium, titanium, molybdenum, tungsten or an alloy of these metals which exhibits poor solder connection and which therefore enables the layer to act as a solder flow preventing layer. In consequence, the structure of the thin film can be simplified, and the wiring portions and the solder connecting portions can be formed successively using the same equipment.

Furthermore, since the thermal printing head according to the present invention does not employ easily corrosive aluminum as the wiring metal, the wiring protecting film can be simplified, and the thickness of the protecting film made of, for example, silicon dioxide, can be greatly reduced, thereby reducing the level of printing energy required.

Furthermore, in the thermal printing head according to the present invention, copper or a copper alloy which forms the wiring portion is used to form the common wiring also. In consequence, the outlet portions of the heating resistors from which the printing paper leaves the heating resistors can be made flat to achieve reduction in the amount of lees of the printing paper.

According to the thermal printing head manufacturing method according to the present invention, the multi-layers which constitute the wiring can be successively formed by the thin-film forming technique, i.e., sputtering. Furthermore, the common wiring, individual wirings and solder connecting portions on the individual wirings can be easily formed utilizing the known fine pattern forming lithographic technique.

What is claimed is:

1. A thermal printing head comprising: a patterned layer of a plurality of heating resistors arranged in line on a high-resistance substrate; a laminated wiring conductor layer consisting of common wiring connected to one end of said patterned heating resistor layer and individual wirings connected to another end of said patterned heating resistor layer, said individual wirings being separated from said common wiring by a predetermined interval; a heat-resistant insulating layer formed at least on said laminated wiring conductor layer and on an exposed portion of said patterned heating resistor layer on which said wiring conductor layer is not formed; an abrasion-resistant protective layer provided at least above said exposed portion of said patterned heating resistor layer with said heat-resistant insulating layer being interposed therebetween; solder connecting portions formed by forming through-holes in a portion of said heat-resistant insulating layer placed on said individual wirings, said solder connecting portions being connected to driving ICs; and driving ICs soldered to said solder connecting portions, wherein said laminated wiring conductor layer includes a plurality of conductor layers in which a first conductor layer exhibits excellent bonding to said heating resistor layer and cannot be readily soldered and hence prevents flow of a solder while a second conductor layer laminated on said first layer is easily soldered and less corrosive than aluminum.

2. A thermal printing head according to claim 1, wherein said heat-resistant insulating layer is made of silicon dioxide, and wherein said abrasion-resistant protective layer is made of silicon nitride.

3. A thermal printing head according to claim 1, wherein said second conductor layer ia made of Cu or Cu alloy.

4. A thermal printing head according to claim 1, wherein said second conductor layer is made of a conductive material selected from a group consisting of Cu, NiCu, CrCu, or a Cu alloy.

5. A thermal printing head according to claim 1, wherein said heat-resistant insulating layer is made of silicon dioxide, and wherein said second conductor layer is made of a conductive material selected from a group consisting of Cu, NiCu, CrCu, or a Cu alloy.

6. A thermal printing head according to claim 1, wherein said first conductor layer is made of a metal selected from a group consisting of chromium, titanium, molybdenum and tungsten, or an alloy of said metals, and wherein said second layer is made of copper or a copper alloy.

7. A thermal printing head comprising: a patterned layer of a plurality of heating resistors arranged in line on a high-resistance substrate; a laminated wiring conductor layer consisting of common wiring connected to one end of said patterned heating resistor layer and individual wirings connected to another end of said patterned heating resistor layer, said individual wirings being separated from said common wiring by a predetermined internal; a heat-resistant insulating layer formed at least on said laminated wiring conductor layer and on an exposed portion of said patterned heating resistor layer on which said wiring conductor layer is not formed; an abrasion-resistant protective layer provided at least above said exposed portion of said patterned heating resistor layer with said heat-resistant insulating layer being interposed therebetween; solder connecting portions formed by forming through-holes in a portion of said heat-resistant insulating layer placed on said individual wirings, said solder connecting portions being connected to driving ICs; and driving ICs solder to said solder connecting portions, wherein said laminated wiring conductor layer consists of only first and second conductor layers, said first conductor layer exhibits excellent bonding to said heating resistor layer and cannot be readily soldered and hence prevents flow of a solder, and said second conductor layer, laminated on said first layer, is easily soldered and is less corrosive than aluminum, and wherein a groove is formed around an exposed portion of said second conductor layer in each of said driving IC soldering portions formed by forming said through-holes in said heat-resistant insulating layer placed on said individual wirings to expose said first conductor layer, said exposed portion of said first conductor layer serving as a solder flow preventing portion during solder connection.

8. A thermal printing head according to claim 7, wherein said heat-resistant insulating layer is made of silicon dioxide, and wherein said abrasion-resistant protective layer is made of silicon nitride.

9. A thermal printing head according to claim 7, wherein said second conductor layer is made of Cu or Cu alloy.

10. A thermal printing head comprising: a patterned layer of a plurality of heating resistors arranged in line on a high-resistance substrate; a laminated wiring conductor layer consisting of common wiring connected to one end of said patterned heating resistor layer and individual wirings connected to another end of said patterned heating resistor layer, said individual wirings being separated from said common wiring by a predetermined internal; a heat-resistant insulating layer formed at least on said laminated wiring conductor layer and on an exposed portion of said patterned heating resistor layer on which said wiring conductor layer is not formed; an abrasion-resistant protective layer provided at least above said exposed portion of said patterned heating resistor layer with said heat-resistant insulating layer being interposed therebetween; solder connecting portions formed by forming through-holes in a portion of said heat-resistant insulating layer placed on said individual wirings, said solder connecting portions being connected to driving ICs; and driving ICs solder to said solder connecting portions, wherein said laminated wiring conductor layer includes three conductor layers in which a first conductor layer exhibits excellent bonding to said heating resistor layer and cannot be readily soldered and hence prevents flow of a solder; a second conductor layer laminated on said first layer is easily soldered and is less corrosive than aluminum; and a third layer laminated on said second conductor layer, and wherein a portion of said third conductor layer located in each of said solder connecting portions, formed by forming the through-holes in the portion of said heat-resistant insulating layer placed on said individual wirings, is selectively removed to expose a portion of said second layer which serves as a solder connecting portion.

11. A thermal printing head according to claim 10, wherein said first and third conductor layers are made of the same metal.

12. A thermal printing head according to either of claims 7, 10 and 11, wherein said first conductor layer is made of a metal selected form a group consisting of chromium, titanium, molybdenum and tungsten, or an alloy of said metals, and wherein said second layer is made of copper or a copper alloy.

13. A thermal printing head according to claim 11, wherein said heat-resistant insulating layer is made of silicon dioxide, and wherein said abrasion-resistant protective layer is made of silicon nitride.

14. A thermal printing head according to claim 11, wherein said second conductor layer is made of Cu or Cu alloy.

15. A thermal printing head according to claim 10, wherein said heat-resistant insulating layer is made of silicon dioxide, and wherein said abrasion-resistant protective layer is made of silicon nitride.

16. A thermal printing head according to claim 10, wherein said second conductor layer is made of Cu or Cu alloy.

* * * * *